US006267638B1

(12) United States Patent
Connolly et al.

(10) Patent No.: US 6,267,638 B1
(45) Date of Patent: Jul. 31, 2001

(54) PILLOW CASE WITH POCKET FOR CHILD'S ARTICLE

(75) Inventors: Sally Connolly, 23 Laurel La., Napa, CA (US) 94558; Paula Bittner, Saratoga, CA (US)

(73) Assignee: Sally Connolly, Calistoga, CA (US)

( * ) Notice: Subject to any disclaimer, the term of this patent is extended or adjusted under 35 U.S.C. 154(b) by 0 days.

(21) Appl. No.: 09/416,002

(22) Filed: Oct. 8, 1999

(51) Int. Cl.[7] ..... A47G 9/02
(52) U.S. Cl. ..... 446/73; 446/227; 5/490
(58) Field of Search ..... 446/73, 227; 5/490

(56) References Cited

U.S. PATENT DOCUMENTS

| | | | | |
|---|---|---|---|---|
| D. 397,902 | * | 9/1998 | Knorrek | 5/490 X |
| 1,513,231 | * | 10/1924 | English | 446/73 |
| 1,686,247 | * | 10/1928 | Murphy | 5/490 X |
| 1,815,070 | * | 7/1931 | Prahar | 446/73 |
| 4,590,633 | * | 5/1986 | Pickens | 446/73 |
| 4,739,529 | * | 4/1988 | Mills | 446/73 |
| 4,754,512 | * | 7/1988 | Chao-Yang | 446/226 |
| 4,768,245 | * | 9/1988 | Dutton | 5/490 X |
| 4,853,994 | * | 8/1989 | Ekstein | 446/73 |
| 5,084,930 | * | 2/1992 | Danova | 446/73 |
| 5,118,318 | * | 6/1992 | Lorizio | 446/72 |
| 5,184,362 | * | 2/1993 | Yager et al. | 5/490 |
| 5,208,934 | * | 5/1993 | Backnick et al. | 446/73 |
| 5,389,028 | * | 2/1995 | Cabrera et al. | 446/73 |
| 5,421,045 | * | 6/1995 | Bowen | 446/73 |
| 5,458,932 | * | 10/1995 | Zinbarg et al. | 446/268 |
| 5,807,155 | * | 9/1998 | Divvleeon | 446/268 |
| 5,989,095 | * | 11/1999 | Wotton | 446/73 |

* cited by examiner

*Primary Examiner*—John A. Ricci
(74) *Attorney, Agent, or Firm*—Jack Lo

(57) ABSTRACT

The present pillow case is comprised of a tubular bag with a closed end and an open end. The bag has a predetermined length such that, when a conventional pillow of a predetermined size is fully inserted into the bag against the closed end, a loose extension is provided on the side of the open end. A flat pocket for holding a child's article is attached to the bag near the open end at a position substantially overlapping an adjacent end of the pillow. An opening on the pocket is angled sharply toward the closed end to more directly present the article to the child, and to hold the article more securely. The positioning of the pocket overlapping the edge of the pillow causes it to be raised by the pillow to about the top plane of the pillow case, and thus places the article within sight of the child for providing enjoyment and companionship.

8 Claims, 2 Drawing Sheets

PILLOW CASE WITH POCKET FOR CHILD'S ARTICLE

BACKGROUND OF THE INVENTION

1. Field of the Invention

This invention relates generally to pillow cases.

2. Prior Art

Many young children like to bring their playthings to sleep. They often feel a sense of security when cuddling with their favorite bedtime companion, such as a plush animal or a toy. However, the plaything often moves around under the sheets or may even fall behind the headboard during the night, so that the child may be unable to find it in the morning.

A child's pillow case is shown in U.S. Pat. No. 5,118,318 to Lorizio. It includes a pillow receiving compartment with a soft fringe around its perimeter. A pair of tubular sacks are each attached to the absolute perimeter of the pillow receiving compartment by detachable fasteners. The sacks do not overlap the sides of the pillow receiving compartment. When the sacks are laden with dolls, the soft fringe cannot support them in a horizontal position, so they droop downward below the top plane of the pillow case and out of the child's line of sight. Therefore, the child cannot see the dolls when lying on the pillow. The sacks are parallel to the side edges of the compartment, so that they may tip and cause the dolls to fall out. The compartment has closed sides. A transverse opening is arranged across the back for inserting a pillow, but such an opening makes inserting a pillow relatively difficult.

In March of 1998, the inventors of the present invention offered a prior art pillow case for sale. As shown in FIG. 1, it is comprised of a tubular bag 10 with a closed end 11 and an open end 12 or receiving a conventional pillow. Bag 10 is substantially longer than a standard pillow of about 25 inches (63.5 cm) wide. When a standard size pillow 13, i.e., the smallest size conventional pillow, is fully inserted into bag 10 against closed end 11, a loose extension 14 is provided on the side of open end 12. A flat pocket 15 with an opening 17 for holding a toy 16 is attached to extension 14 near open end 12 at a position substantially spaced from an adjacent end of pillow 13. Pocket 15 is substantially orthogonal to a longitudinal side of bag 10 to present the side of toy 16 to a child. As shown in FIG. 2, due to the length of extension 14 and the position of pocket 15, toy 16 is positioned well below a top plane 18 of bag 10, and therefore out of a line of sight 19 of the child.

OBJECTS OF THE INVENTION

Accordingly, objects of the present pillow case are:

- to cover a pillow of different sizes, from standard size to king size;
- to provide a pocket for holding a child's article and preventing it from becoming lost in the sheets;
- to position the article at about the top plane of the pillow case;
- to present the article more directly to the child; and
- to hold the article more securely to prevent it from falling out.

Further objects of the present invention will become apparent from a consideration of the drawings and ensuing description.

BRIEF SUMMARY OF THE INVENTION

The present pillow case is comprised of a tubular bag with a closed end and an open end. The bag has a predetermined length such that, when a conventional pillow of a predetermined size is fully inserted into the bag against the closed end, a loose extension is provided on the side of the open end. A flat pocket for holding a child's article is attached to the bag near the open end at a position substantially overlapping an adjacent end of the pillow. An opening on the pocket is angled sharply toward the closed end to more directly present the article to the child, and to hold the article more securely. The positioning of the pocket overlapping the edge of the pillow causes it to be raised by the pillow to about the top plane of the pillow case, and thus places the article within sight of the child for providing enjoyment and companionship.

DRAWING REFERENCE NUMERALS

10. Bag
11. Closed End
12. Open End
13. Pillow
14. Extension
15. Pocket
16. Article
17. Opening
18. Top Plane
19. Line of Sight
20. Bag
21. Closed End
22. Open End
23. Pillow
24. Extension
25. Pocket
26. Article
27. Opening
28. Top Plane
29. Line of Sight
30. Inner Corner

DETAILED DESCRIPTION OF THE INVENTION

Figure 1:
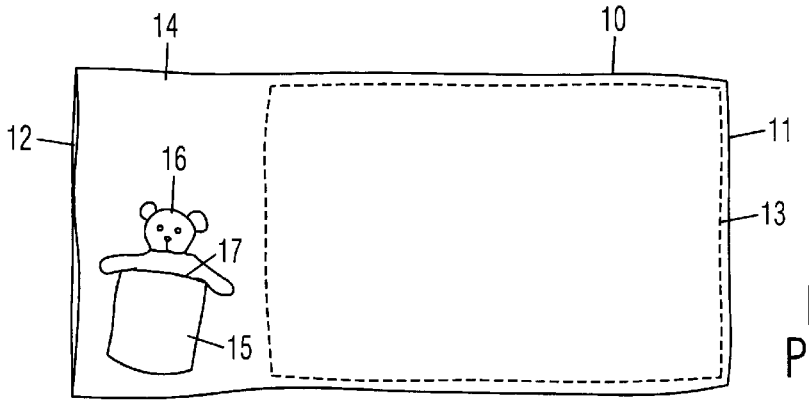
Fig. 1 Prior Art
FIG. 1 is a top view of a prior art pillow case.
Figure 2:
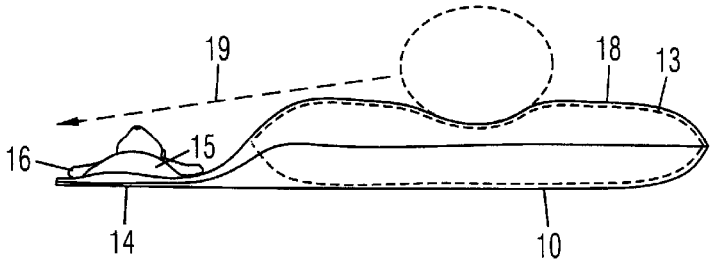
Fig. 2 Prior Art
FIG. 2 is a side view of the prior art pillow case in use.
Figure 3:
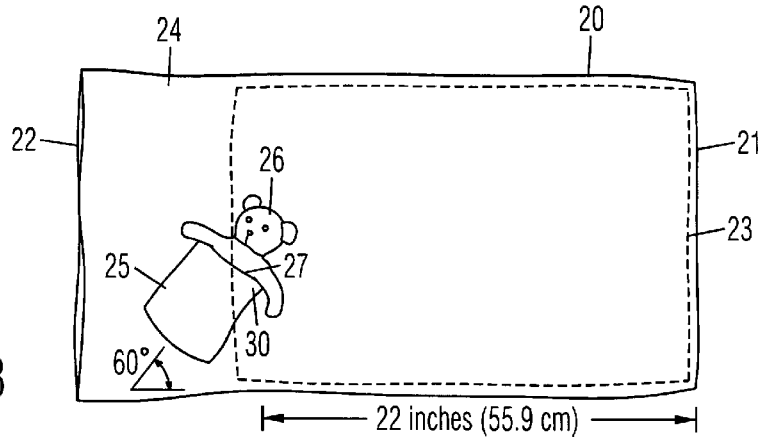
FIG. 3 is a top view of the present pillow case.

A preferred embodiment of the present pillow case is shown in a top view in FIG. 3. It is comprised of a tubular bag 20 with a closed end 21 and an open end 22. Bag 20 has a predetermined length such that, when a conventional pillow 23 of a predetermined length is fully inserted into bag 20 against closed end 21, a loose extension 24 is provided on the side of open end 22.

Figure 4:
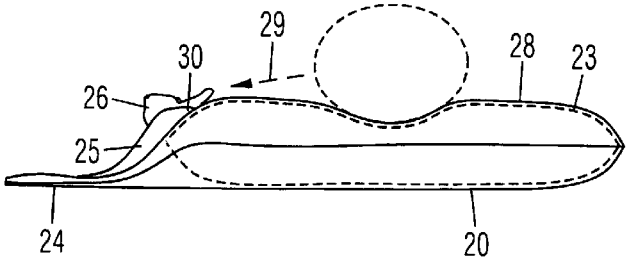
FIG. 4 is a side view of the present pillow case in use.
Figure 5:
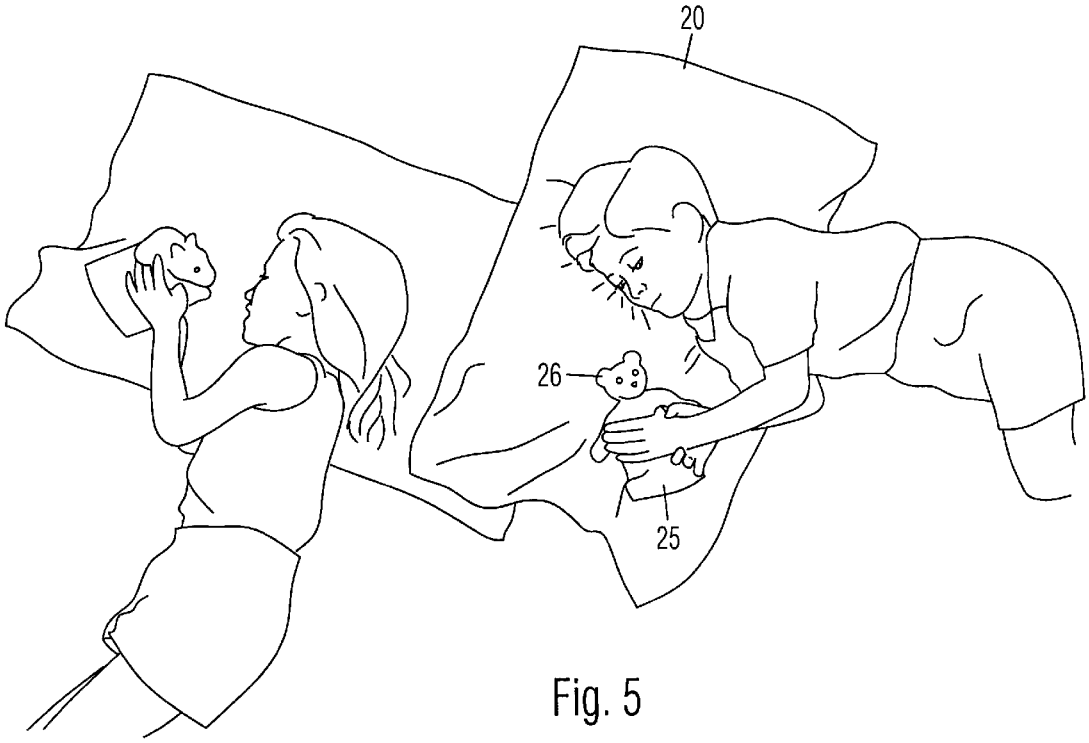
FIG. 5 is a top perspective view of the present pillow case in use.

A flat pocket 25 with a opening 27 for holding a child's toy or article 26 is attached to bag 20 near open end 22 at a position substantially overlapping an adjacent end of pillow 23. Three edges of pocket 25 are secured to bag 10, so that pocket 25 does not flap around like some prior art toy sacks. Pocket 25 is angled sharply toward closed end 21 to more directly present article 26 to the child, and to hold article 26 more securely. The positioning of pocket 25 substantially overlapping the edge of pillow 23 is critical, because such positioning causes pocket 25 to be raised by pillow 23 to about a top plane 28 of the pillow case, as shown in FIG. 4. Article 26 is thus within a line of sight 29 of the child for providing enjoyment and companionship, as shown in FIGS. 4 and 5. Any child's article may be held in pocket 25, including toys, cards, money envelope, etc. Article 26 is secured on the pillow case, so that it cannot get lost under the sheets or fall behind a headboard.

In this embodiment, pillow receiving bag 20 is preferably about 33.5 inches (85.1 cm) long between closed end 21 and open end 22 for receiving any pillow from a standard size pillow about 25 inch (63.5 cm) long to a king size pillow about 32 inch (81.3 cm) long (pillow length is measured as a straight line distance between opposite ends of a filled pillow). An inner corner 30 of pocket 25 is preferably about 22 inches (55.9 cm) from closed end 21, so that it is lifted by a sloped end of a standard size pillow, which is most likely the pillow used by a child, and is the one illustrated in FIGS. 3–4. When a king size pillow is inserted into the pillow case, pocket 25 and article 26 are fully raised to the top plane of the pillow case. As shown in FIG. 3, pocket 25 is preferably positioned about 60 degrees relative to a longitudinal edge of bag 20 for more directly presenting article 26 to the child. As shown in FIG. 4, article 26 is positioned on an inclined edge of pillow 23. Therefore, the incline of pocket 25 also helps to hold article 26 more securely.

SUMMARY AND SCOPE

Accordingly, the present pillow case provides a bag for receiving a pillow of any size, from standard to king size. It provides a pocket for holding a child's article and preventing it from becoming lost in the sheets or falling behind a headboard. It positions the article at about the top plane of the pillow case, within sight of the child to provide enjoyment and companionship. It presents the article more directly to the child. It also holds the article more securely to prevent it from falling out.

Although the above description is specific, it should not be considered as a limitation on the scope of the invention, but only as an example of the preferred embodiment. Many variations are possible within the teachings of the invention. For example, the entire pillow may be made of a plain or decorative fabric. The extension may be made of a decorative fabric, whereas the rest of the pillow case may be made of a plain fabric. Therefore, the scope of the invention should be determined by the appended claims and their legal equivalents, not by the examples given.

What is claimed is:

1. A pillow case, comprising:

a tubular bag with a closed end and an open end for receiving a pillow of about 25 inches (63.5 cm) in length, said bag having a predetermined length substantially greater than the length of said pillow, so that when said pillow is fully inserted into said bag against said closed end, a loose extension of said bag is provided adjacent said open end; and a pocket for holding a child's article, said pocket being attached to said bag near said open end overlapping a position which is about 25 inches (63.5 cm) from said closed end of said pillow case, a substantial portion of said pocket for being raised by said pillow to about a top plane of said pillow for placing said article within a line of sight of a child for providing enjoyment and companionship.

2. The pillow case of claim 1, wherein said bag is at least about 33.5 inches (85.1 cm) long between said closed end and said open end for receiving said pillow.

3. The pillow case of claim 1, wherein an inner corner of said pocket is about 22 inches (55.9 cm) from said closed end, so that a substantial portion of said pocket is adapted to substantially overlap an adjacent edge of said standard size pillow of about 25 inches (63.5 cm) long and is adapted to be lifted by said standard size pillow to about a top plane of said standard size pillow.

4. The pillow case of claim 1, wherein said pocket is angled about 60 degrees relative to a longitudinal edge of said bag for more directly presenting said article to said child, and for holding said article more securely.

5. A pillow case, comprising:

a tubular bag with a closed end and an open end for receiving a pillow of about 25 inches (63.5 cm) in length, said bag having a predetermined length substantially greater than the length of said pillow, so that when said pillow is fully inserted into said bag against said closed end, a loose extension of said bag is provided adjacent said open end; and a pocket for holding a child's article, said pocket being attached to said bag near said open end overlapping a position which is about 25 inches (63.5 cm) from said closed end of said pillow case, a substantial portion of said pocket for being raised by said pillow to about a top plane of said pillow for placing said article within a line of sight of a child for providing enjoyment and companionship, an opening of said pocket being substantially angled toward said closed end of said bag for more directly presenting said article to said child, and for holding said article more securely on a sloped surface of said pillow.

6. The pillow case of claim 5, wherein said bag is at least about 33.5 inches (85.1 cm) long between said closed end and said open for receiving said pillow.

7. The pillow case of claim 5, wherein an inner corner of said pocket is about 22 inches (55.9 cm) from said closed end, so that a substantial portion of said pocket is adapted to substantially overlap an adjacent edge of said standard size pillow of about 25 inches (63.5 cm) long and is adapted to be lifted by said standard size pillow to about a top plane of said standard size pillow.

8. The pillow case of claim 5, wherein said pocket is angled about 60 degrees relative to a longitudinal edge of said bag for more directly presenting said article to said child, and for holding said article more securely.

* * * * *